US010195850B2

(12) United States Patent
Kasai et al.

(10) Patent No.: US 10,195,850 B2
(45) Date of Patent: Feb. 5, 2019

(54) ELEMENT SUBSTRATE AND METHOD FOR MANUFACTURING THE SAME

(71) Applicant: CANON KABUSHIKI KAISHA, Tokyo (JP)

(72) Inventors: Shintaro Kasai, Yokohama (JP); Akiko Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/687,240

(22) Filed: Aug. 25, 2017

(65) Prior Publication Data

US 2018/0056653 A1 Mar. 1, 2018

(30) Foreign Application Priority Data

Aug. 30, 2016 (JP) ..... 2016-168005

(51) Int. Cl.
*B41J 2/14* (2006.01)
*B41J 2/16* (2006.01)

(52) U.S. Cl.
CPC ..... *B41J 2/1433* (2013.01); *B41J 2/1404* (2013.01); *B41J 2/162* (2013.01); *B41J 2/1603* (2013.01); *B41J 2/1631* (2013.01); *B41J 2/1637* (2013.01); *B41J 2/1639* (2013.01); *B41J 2002/14467* (2013.01); *B41J 2002/14475* (2013.01)

(58) Field of Classification Search
CPC ..... B41J 2/1404; B41J 2/1603; B41J 2/162; B41J 2/1631; B41J 2/1637; B41J 2/1639; B41J 2/1433
See application file for complete search history.

(56) References Cited

U.S. PATENT DOCUMENTS 7,298,856 B2 * 11/2007 Tajima ..... H04R 19/005 381/111
2013/0076835 A1 * 3/2013 Oikawa ..... B41J 2/1404 347/54

FOREIGN PATENT DOCUMENTS

JP 2007-137056 A 6/2007
JP 2008-149519 A 7/2008

* cited by examiner

*Primary Examiner* — Lamson Nguyen
(74) *Attorney, Agent, or Firm* — Canon U.S.A., Inc. IP Division

(57) ABSTRACT

An element substrate includes a substrate including a supply port configured to supply liquid, and a discharge port forming member including a discharge port configured to discharge the liquid supplied from the supply port. The discharge port forming member includes a liquid flow path communicating between the discharge port and the supply port on a surface opposed to a surface where the discharge port is provided. The discharge port forming member includes thick film portions and thin film portions in a region where the liquid flow path is formed. The thick film portions are lined up in a first direction so as to sandwich the discharge port therebetween and thicker than an adjacent portion adjacent to the discharge port. The thin film portions are lined up in a second direction intersecting with the first direction so as to sandwich the discharge port therebetween and thinner than the adjacent portion.

2 Claims, 12 Drawing Sheets

ELEMENT SUBSTRATE AND METHOD FOR MANUFACTURING THE SAME

BACKGROUND OF THE INVENTION

Field of the Invention

The present disclosure relates to an element substrate that discharges liquid and a method for manufacturing the element substrate.

Description of the Related Art

Many of liquid discharge heads for use in a liquid discharge apparatus, such as an inkjet recording apparatus, include an element substrate having a discharge port forming member where a plurality of discharge ports configured to discharge liquid is formed and a substrate where a plurality of supply ports configured to supply the liquid to the discharge ports is formed. The discharge port forming member includes a pressure chamber, a liquid chamber, and a flow path formed on the surface opposed to the surface where the discharge ports are provided. The pressure chamber is provided at a position facing the discharge port and stores therein the liquid to be discharged from the discharge port. The liquid supplied from the supply port is supplied into the liquid chamber. The flow path guides the liquid supplied into the liquid chamber to the pressure chamber.

In an element substrate like the above-described example, the discharge port forming member is constantly in contact with the liquid under a normal usage environment, which may bring about a change in a volume of the discharge port forming member due to swelling, thereby causing a deformation of the discharge port. In particular, in a case where the discharge port forming member is made from resin and a thickness thereof is 6 μm or thinner, the discharge port is noticeably deformed due to the swelling. The deformation of the discharge port may bring about a change in a discharge amount of the discharged liquid, which may affect, for example, an image quality of a recorded image.

To that end, Japanese Patent Application Laid-Open No. 2007-137056 discusses an element substrate in which a hollow portion independent of the pressure chamber is provided in a wall member forming the pressure chamber. This element substrate can alleviate the change in the volume due to the swelling with the hollow portion, thereby enabling prevention or reduction of the deformation of the discharge port.

Japanese Patent Application Laid-Open No. 2008-149519 discusses an element substrate in which the discharge port forming member is formed for each of the discharge ports, and each of the discharge port forming members is disposed while being spaced apart from each other. This element substrate can alleviate the change in the volume due to the swell with the space between the discharge port forming members, thereby enabling prevention or reduction of the deformation of the discharge port.

In recent years, an increase in the number of discharge ports on the element substrate has been demanded to, for example, improve a recording quality and speed up recording, and this demand has raised a necessity of increasing a density of the discharge ports according thereto. In the case of the element substrate where the discharge ports are dispose at a high density, the prevention or reduction of the deformation of the discharge port with use of the techniques discussed in Japanese Patent Application Laid-Open No. 2007-137056 and/or Japanese Patent. Application Laid-Open No. 2008-149519, requires the forming of the hollow portion in the wall member or the space between the discharge port forming members with high accuracy, which requires an advanced technique.

SUMMARY OF THE INVENTION

The present disclosure has been made in consideration of the above and is directed to providing an element substrate capable of easily preventing or reducing the deformation of the discharge port due to the swelling, and a method for manufacturing the element substrate.

According to an aspect of the present disclosure, an element substrate includes a substrate including a supply port configured to supply liquid, and a discharge port forming member including a discharge port configured to discharge the liquid supplied from the supply port. The discharge port forming member includes, on a surface opposed to a surface where the discharge port is provided, a liquid flow path communicating between the discharge port and the supply port, and includes thick film portions and thin film portions in a region where the liquid flow path is formed. The thick film portions are lined up in a first direction so as to sandwich the discharge port therebetween and thicker than an adjacent portion adjacent to the discharge port. The thin film portions are lined up in a second direction intersecting with the first direction so as to sandwich the discharge port therebetween and thinner than the adjacent portion.

According to another aspect of the present disclosure, a first method for manufacturing an element substrate includes forming, on a substrate, recessed portions to be lined up in a first direction so as to sandwich a predetermined region therebetween, and protruding portions lined up in a second direction intersecting with the first direction so as to sandwich the region therebetween, forming, on the recessed portions and the protruding portions, a mold member including, on a surface opposed to one side facing the recessed portions and the protruding portions, recesses and protrusions in conformity to recesses and protrusions formed on the recessed portions and the protruding portions, forming a discharge port forming member on the mold member, forming a discharge port configured to discharge liquid at a position, on the discharge port forming member, facing the region, forming a supply port configured to supply the liquid at a position, on the substrate, facing the mold member, and removing the mold member.

According to yet another aspect of the present disclosure, a second method for manufacturing an element substrate includes forming a mold member on a substrate, forming, on the mold member, a plurality of recessed portions to be lined up in a first direction so as to sandwich a predetermined region therebetween, and a plurality of protruding portions to be lined up in a second direction intersecting with the first direction so as to sandwich the region therebetween, forming a discharge port forming member on the mold member, forming a discharge port configured to discharge liquid, at a position, on the discharge port forming member, facing the region, forming a supply port configured to supply the liquid, at a position, on the substrate, facing the mold member, and removing the mold member.

According to yet another aspect of the present disclosure, a liquid discharge head includes a substrate including an energy generation element configured to generate energy to be used to discharge liquid, and a discharge port forming member including a discharge port configured to discharge the liquid. The discharge port forming member includes, on a surface opposed to a surface where the discharge port is provided, a liquid flow path configured to supply the liquid to the energy generation element, and includes thick film portions and thin film portions in a region where the liquid flow path is formed. The thick film portions are lined up in a first direction so as to sandwich the discharge port therebetween and thicker than an adjacent portion adjacent to the discharge port. The thin film portions are lined up in a second direction intersecting with the first direction so as to sandwich the discharge port therebetween and thinner than the adjacent portion.

Further features of the present disclosure will become apparent from the following description of exemplary embodiments with reference to the attached drawings.

DESCRIPTION OF THE EMBODIMENTS

Figure 1A:
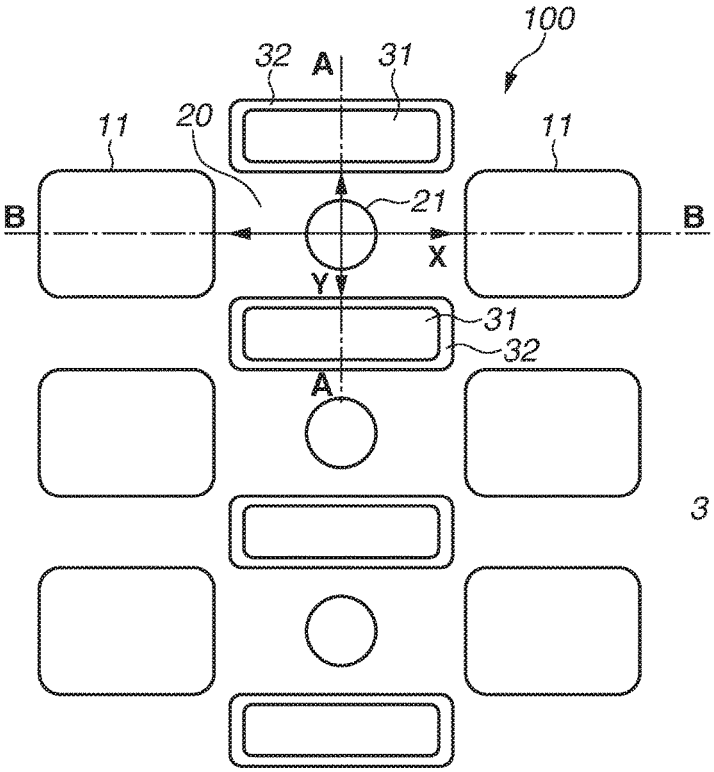
FIGS. 1A to 1C are a plan view and cross-sectional views each illustrating an element substrate according to a first exemplary embodiment of the present disclosure.

In the following description, exemplary embodiments of the present disclosure will be described with reference to the drawings. Components having a similar function will be identified by the same reference numeral in each of the drawings, and a description thereof may be omitted.

Figure 1B:
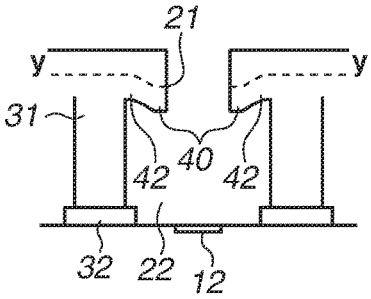
Figure 1C:
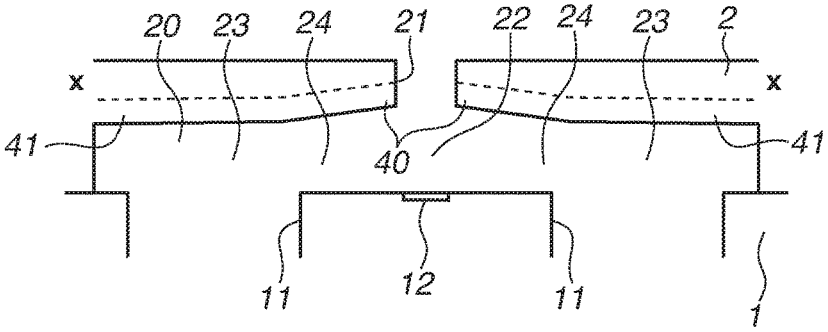

FIGS. 1A to 1C are a plan view and cross-sectional views each illustrating an element substrate according to a first exemplary embodiment of the present disclosure. FIG. 1A is a transparent plan view of the element substrate according to the present exemplary embodiment. FIG. 1B is a cross-sectional view taken along a line A-A illustrated in FIG. 1A. FIG. 1C is a cross-sectional view taken along a line B-B illustrated in FIG. 1A. FIGS. 1A to 1C illustrate an element substrate 100 in an initial state not swelling due to liquid.

The element substrate 100 illustrated in FIGS. 1A to 1C is mounted on a liquid discharge head for use in a liquid discharge apparatus such as an inkjet recording apparatus. The element substrate 100 includes a substrate and a discharge port forming member 2 attached to the substrate 1.

A plurality of supply ports 11, which supplies liquid to the discharge port forming member 2, is provided on the substrate 1. The supply ports 11 penetrate through the substrate 1. In the example illustrated in FIGS. 1A to 1C, the supply ports 11 are disposed so as to form a plurality of supply port rows (two supply port rows in FIGS. 1A to 1C) parallel with each other or one another.

A plurality of energy generation elements 12, which generates energy to be used to discharge the liquid, is lined up on the surface of the substrate 1 that is attached to the discharge port forming member 2. In the present exemplary embodiment, the energy generation elements 12 are each a heater that generates heat energy. Further, the energy generation elements 12 are individually provided between the supply ports 11 included in the supply port rows adjacent to each other.

A plurality of discharge ports 21, which discharges the liquid, is each lined up at a position facing the corresponding one of the energy generation elements 12 of the substrate 1 on the surface, of the discharge port forming member 2, opposed to the surface thereof attached to the substrate 1. A liquid flow path 20 in communication with the discharge port 21 is formed on the surface of the discharge port forming member 2 that is attached to the substrate 1, and this liquid flow path 20, and the supply port 11 and the energy generation element 12 on the substrate 1 face each other. A portion of the liquid flow path 20 that faces the energy generation element 12 functions as a pressure chamber 22 that stores therein the liquid to be discharged from the discharge port 21. This leads to the pressure chamber 22 including the energy generation element 12 therein. Furthermore, a portion of the liquid flow path 20 that faces the supply port 11 functions as a liquid chamber 23 to which the liquid is supplied from the supply port 11, and a portion of the liquid flow path 20 that is in communication with the pressure chamber 22 and the liquid chamber 23 functions as a flow path 24 that guides the liquid supplied into the liquid chamber 23 to the pressure chamber 22. In the present exemplary embodiment, a plurality of flow paths 24 (in particular, two flow paths 24) is provided for one pressure chamber 22 so as to sandwich this pressure chamber 22 therebetween.

A flow path wall 31, which is a wall member fixed to the substrate 1, is provided between the pressure chambers 22 adjacent to each other, and partitions them. An adhesion layer 32, which allows the substrate 1 and the flow path wall 31 to adhere to each other, is provided between the substrate 1 and the flow path wall 31. The adhesion layer 32 extends beyond the flow path wall 31 toward the pressure chamber 22 side. The flow path wall 31 and the discharge port forming member 2 are made from epoxy resin.

In the present exemplary embodiment, a diameter of the discharge port 21 is 20 μm, and a height from the substrate 1 to the surface of the discharge port forming member 2 where the discharge port 21 is provided is 5 μm. A width of the liquid flow path 20 (a distance between the flow path walls 31) is 30 μm, and a distance from the energy generation element 12 to an edge just in front of the supply port 11 is 30 μm.

A film thickness, which is a thickness of a region of the discharge port forming member 2 where the liquid flow path 20 is formed, is different depending on a location. The film thickness of the discharge port forming member 2 is 3 μm at an adjacent portion 40 adjacent to the discharge port 21. On the discharge port forming member 2, a plurality of thick film portions 41 thicker than the adjacent portion 40 is lined up in a first direction X so as to sandwich the discharge port 21 therebetween, and, further, a plurality of thin film portions 42 thinner than the adjacent portion 40 is lined up in a second direction Y intersecting with the first direction X so as to sandwich the discharge port 21 therebetween. Desirably, a maximum thickness of the thick film portion 41 is thicker than the thickness of the adjacent portion 40 by 0.5 μm or more, and a minimum thickness of the thin film portion 42 is thinner than the thickness of the adjacent portion 40 by 0.5 μm or more. in the present exemplary embodiment, the maximum thickness of the thick film portion 41 is 3.5 μm, and the minimum thickness of the thin film portion 42 is 2.5 μm.

Desirably, the first direction X and the second direction Y are orthogonal to each other. In the present exemplary embodiment, the first direction X is a direction in which the discharge port 21 and the supply port 11 are lined up, and the liquid flow path 20 is provided along the first direction X. The second direction Y is a direction in which the discharge port 21 and the flow path wall 31 are lined up, and is orthogonal to the first direction X.

Figure 2:
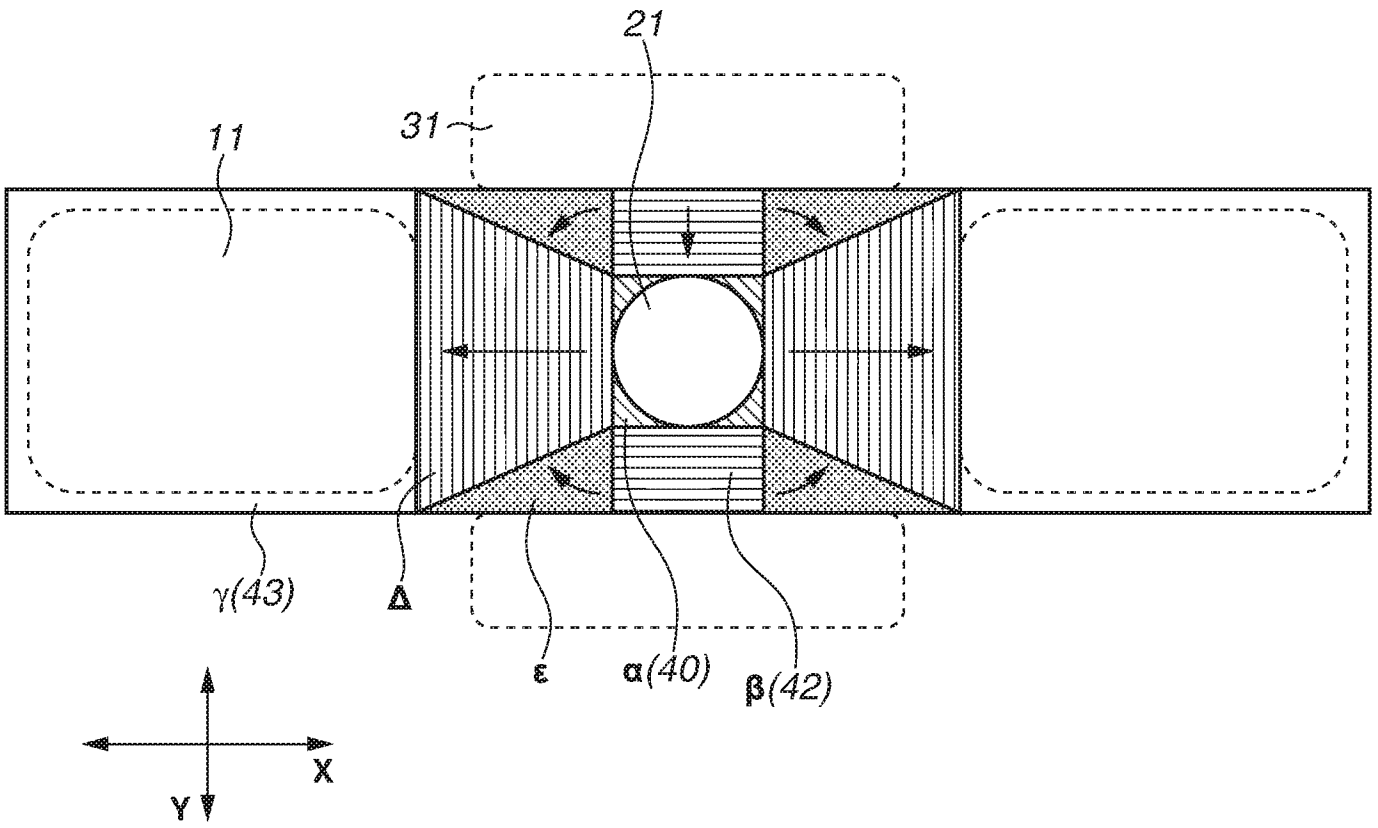
FIG. 2 is a schematic view illustrating a distribution of a film thickness of a discharge port forming member.

FIG. 2 is a schematic view schematically illustrating a distribution of the film thickness of the discharge port forming member 2, and illustrates a top surface around the discharge port 21. In FIG. 2, the adhesion layer 32 is not illustrated for the sake of convenience.

In the example illustrated in FIG. 2, the film thickness increases toward directions indicated by arrows. More specifically, a film thickness of a region a (a region in a rectangle circumscribed to the discharge port 21), which is the adjacent portion 40 adjacent to the discharge port 21, is substantially kept even at 3 μm. A region β between the region α and the flow path wall 31 is the thin film portion 42. A film thickness thereof increases from the flow path wall 31 toward the discharge port 21, and is 2.5 μm and 3 μm at a portion adjacent to the flow path wall 31 and a portion adjacent to the region α, respectively. A region γ facing the supply port 11, and a trapezoidal region δ between the region α and the region γ form the thick film portion 41. A film thickness of the region γ 43 is kept even at 3.5 μm. In the region δ, the film thickness increases from the discharge port 21 toward the supply port 11, and is 3 μm and 3.5 μm at a portion adjacent to the region α and a portion adjacent to the region δ, respectively. In a triangular region ε sandwiched between the region β and the region δ, a film thickness is minimized as thin as 2.5 μm at a right angle portion where the flow path wall 31 and a boundary line between the region β and the region ε intersect with each other, and increases from the right angle portion toward the region δ.

When the liquid is supplied from the supply port to the element substrate 100 in the initial state illustrated in FIGS. 1A to 1C and 2 to fill the pressure chamber 22 with the liquid, water and a solvent contained in the liquid permeate the epoxy resin forming the discharge port forming member 2 and the flow path wall 31. As a result, the discharge port forming member 2 and the flow path wall 31 swell and are deformed.

Figure 3A:
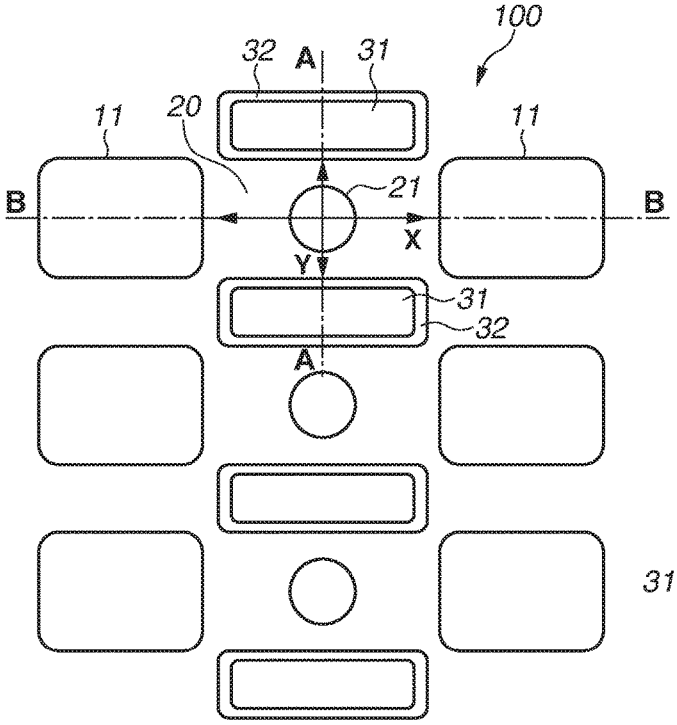
FIGS. 3A to 3C are a plan view and cross-sectional views each illustrating one example of the element substrate in a swelling state, respectively.
Figure 3B:
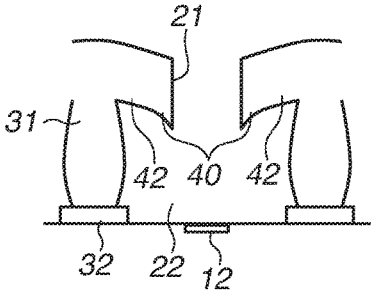
Figure 3C:
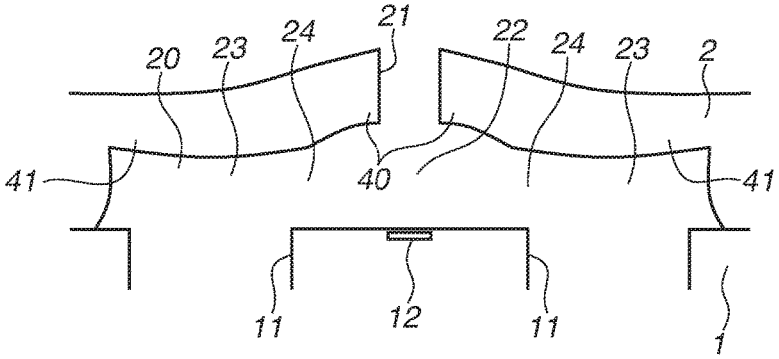

FIGS. 3A to 3C are a plan view and cross-sectional views each illustrating the element substrate 100 in a swelling state in which the discharge port forming member 2 and the flow path wall 31 swell. More specifically, FIG. 3A is a transparent plan view of the element substrate 100. FIG. 3B is a cross-sectional view taken along a line A-A illustrated in FIG. 3A. FIG. 3C is a cross-sectional view taken along a line B-B illustrated in FIG. 3A. FIGS. 3A to 3C schematically illustrate a result acquired from a numerical calculation of the deformation due to the swelling with use of a commercially available structure simulator. Here, to make the deformations of the discharge port forming member 2 and the flow path wall 31 due to the swelling easily understandable, these deformations are emphatically illustrated and different from actual deformations.

The height of the flow path wall 31 increases in the swelling state compared with the initial state. Further, the discharge port forming member 2 is deflected by swelling, by which the discharge port 21 is deformed.

At this time, in the above-described configuration, the discharge port forming member 2 around the discharge port 21 is deflected toward the opposite side from the substrate 1 in the first direction X, and deflected toward the substrate side in the second direction Y.

More specifically, regarding the second direction Y, the center line (line y in FIG. 1B) in a thickness direction of the discharge port forming member 2 protrudes toward the substrate 1 side around the discharge port 21 in the initial state. In such a case, the discharge port forming member 2 is deflected toward the substrate 1 side around the discharge port 21 in the swelling state. On the other hand, regarding the first direction X, the center line (line x in FIG. 1C) in the thickness direction of the discharge port forming member 2 protrudes toward the opposite side from the substrate 1 in the initial state. In this case, the discharge port forming member 2 is deflected toward the opposite side from the substrate 1 around the discharge port 21 in the swelling state.

The discharge port forming member 2 is deflected toward the opposite directions between the first direction X and the second direction Y in this manner, which leads to generation of the deflections in directions causing them to cancel out each other, making it possible to prevent or reduce the deformation of the discharge port 21.

Figure 4A:
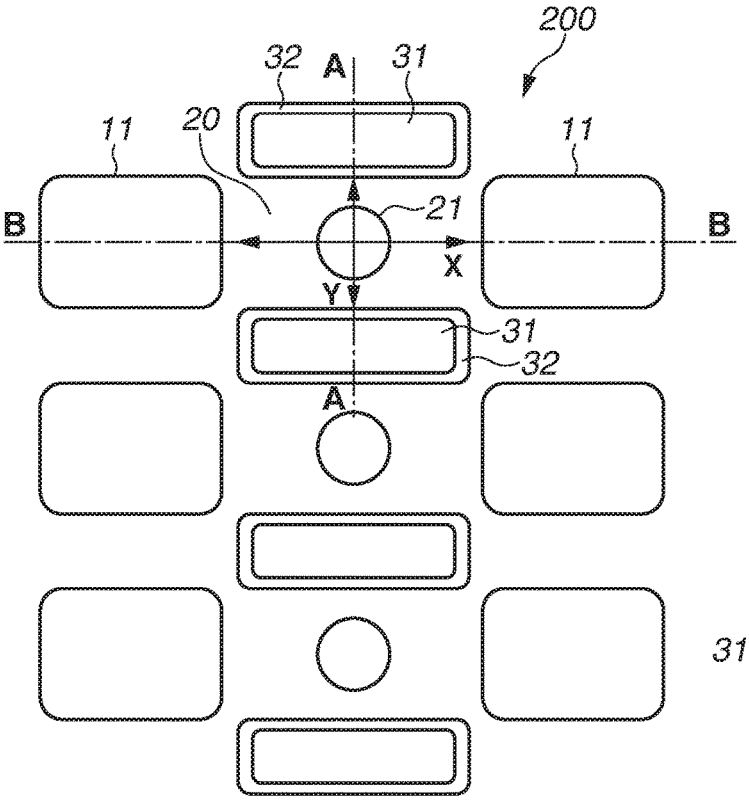
FIGS. 4A to 4C are a plan view and cross-sectional views each illustrating an element substrate according to a reference example in an initial state.
Figure 4B:
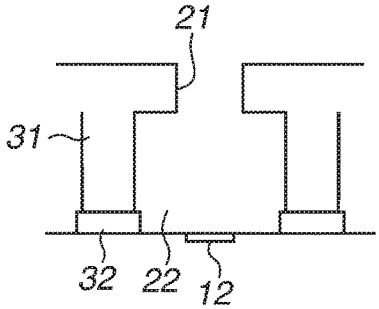
Figure 4C:
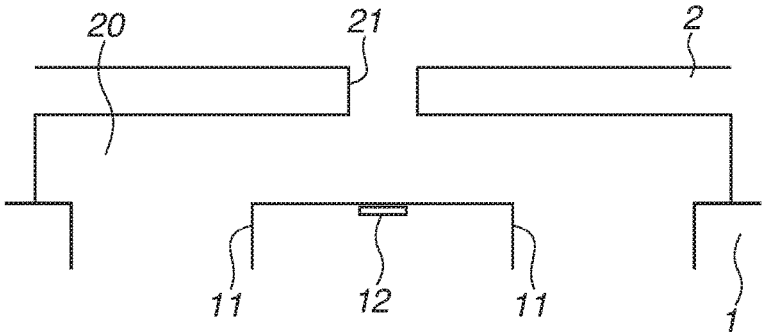
Figure 5A:
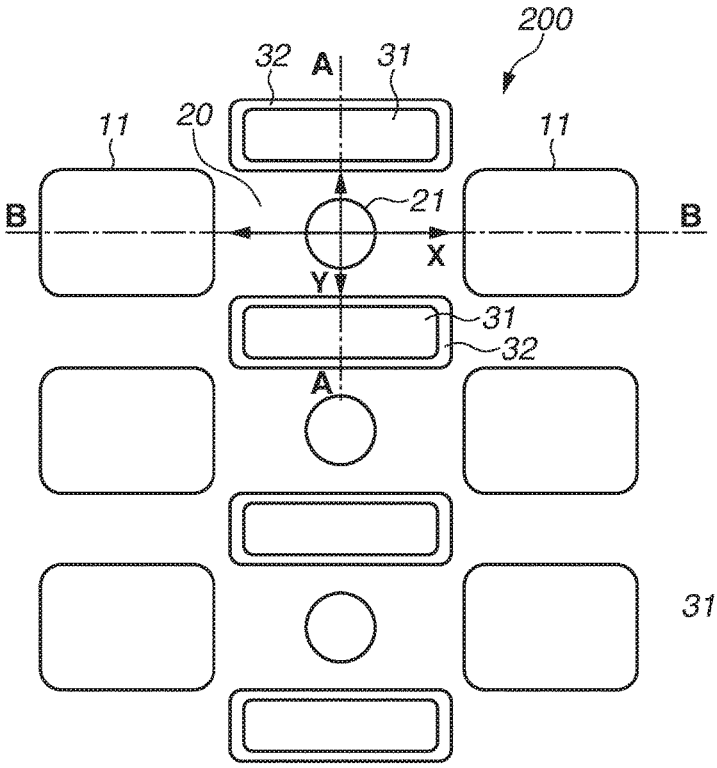
FIGS. 5A to 5C are a plan view and cross-sectional views each illustrating the element substrate according to the reference example in the swelling state.
Figure 5B:
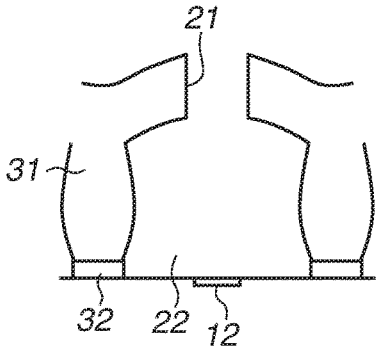
Figure 5C:
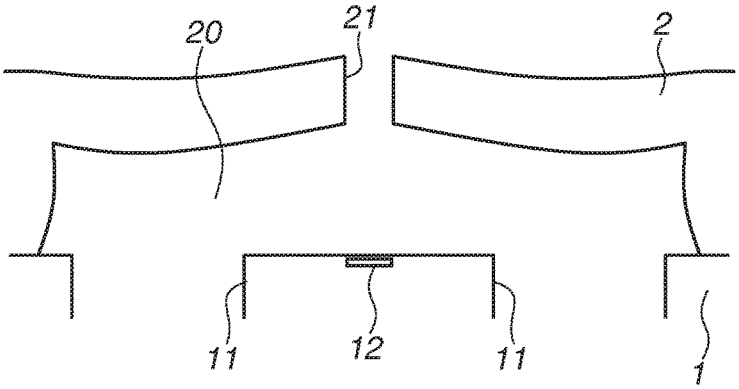

FIGS. 4A to 4C and 5A to 5C are plan views and cross-sectional views each illustrating an element substrate 200 according to a reference example in which the discharge port forming member 2 has an even thickness. More specifically, FIGS. 4A to 4C each illustrate the element substrate 200 according to the reference example in the initial state, and FIGS. 5A to 5C each illustrate the element substrate 200 according to the reference example in the swelling state. FIGS. 4A and 5A are transparent plan views of the element substrate 200. FIGS. 4B and 5B are cross-sectional views taken along lines A-A illustrated in FIGS. 4A and 5A, respectively. FIGS. 4C and 5C are cross-sectional views taken along lines B-B illustrated in FIGS. 4A and 5A, respectively. Each of components of the element substrate 200 according the reference example is identified by the same reference numeral as the corresponding component in the element substrate 100 according to the present exemplary embodiment for the sake of convenience.

As illustrated in FIGS. 4A to 4C and 5A to 5C, when the element substrate 200 according to the reference example swells, the discharge port forming member 2 is deflected toward the opposite side from the substrate 1 around the discharge port 21 in both the first direction X and the second direction Y. The deflections thus do not cancel out each other, so that the discharge port 21 is considerably deformed.

Figure 6A:
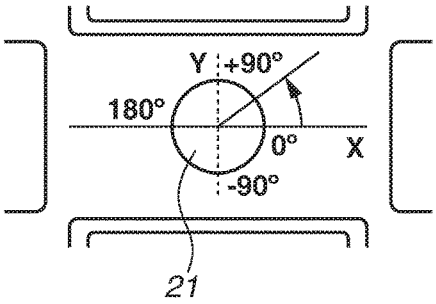
FIGS. 6A and 6B illustrate one example of a height of an edge of a discharge port in the swelling state.
Figure 6B:
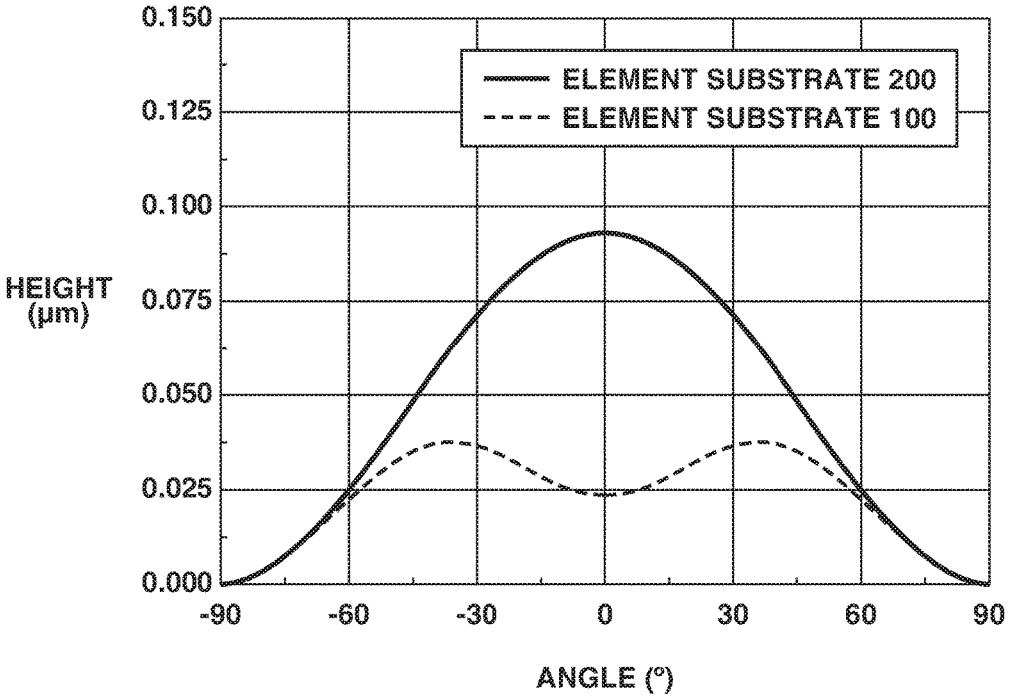

FIGS. 6A and 6B each illustrate a shape of the discharge port 21 when the element substrate is in the swelling state with respect to each of the element substrate 100 according to the present exemplary embodiment and the element substrate 200 according to the reference example. FIG. 6B illustrates a height of an edge of the discharge port 21, and indicates a position of the edge of the discharge port 21 as an argument assuming that the center of the discharge port 21 is an origin and a right side of the discharge port 21 in the first direction X is 0 degrees as illustrated in FIG. 6A. this case, for example, the first direction X corresponds to 0 degrees and 180 degrees, and the second direction Y corresponds to ±90 degrees. FIG. 6B indicates the height of the edge of the discharge port 21 of the element substrate 100 according to the present exemplary embodiment by a dotted line, and the height of the edge of the discharge port 21 of the element substrate 200 according to the reference example by a solid line.

As illustrated in FIG. 6B, the discharge port 21 is less deformed and a height difference of the edge of the discharge port 21 reduces by half in the case of the element substrate 100 according to the present exemplary embodiment compared with the element substrates 200 according to the reference example.

Figure 7A:
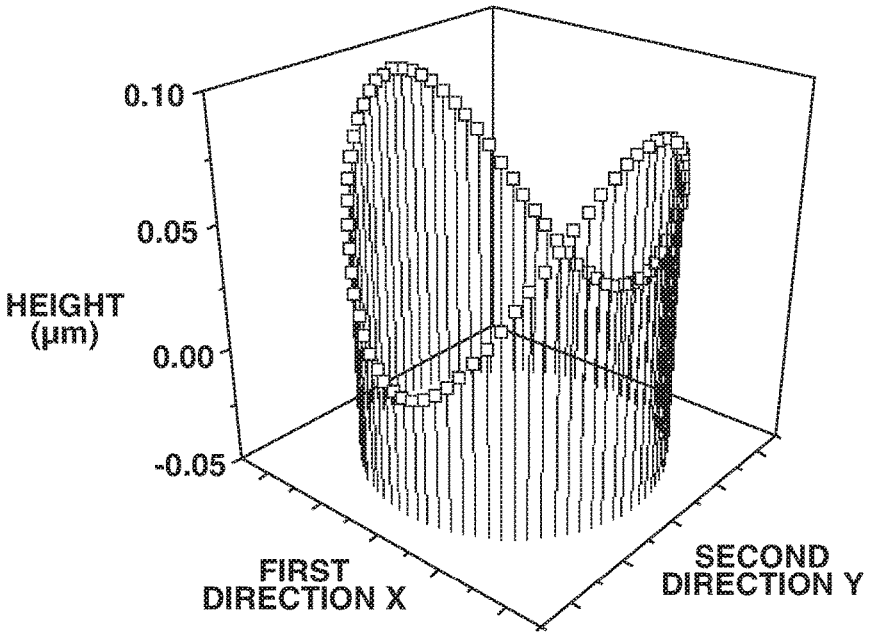
FIGS. 7A and 7B illustrate one example of the shape of the discharge port in the swelling state.
Figure 7B:
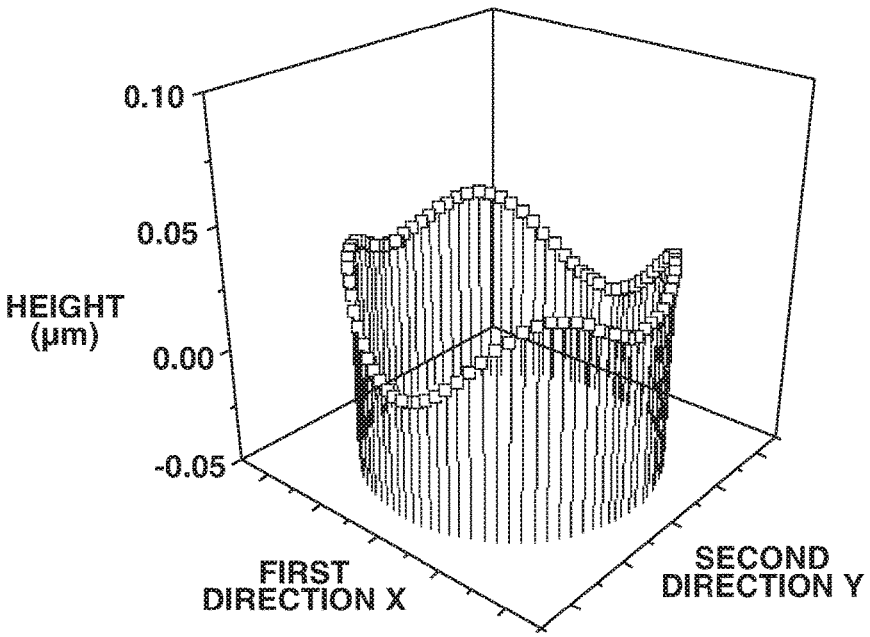

FIGS. 7A and 7B three-dimensionally illustrate the shape of the discharge port 21. More specifically, FIG. 7A illustrates the shape of the discharge port 21 of the element substrate 200 according to the reference example, and FIG. 7B illustrates the shape of the discharge port 21 of the element substrate 100 according to the present exemplary embodiment. FIGS. 7A and 7B also indicate that the discharge port 21 is less deformed in the element substrate 100 according to the present exemplary embodiment compared with the element substrate 200 according to the reference example.

The above-described shapes and the dimensions of the element substrate 100 according to the present exemplary embodiment are merely one example, and can be changed as appropriate.

Figure 8:
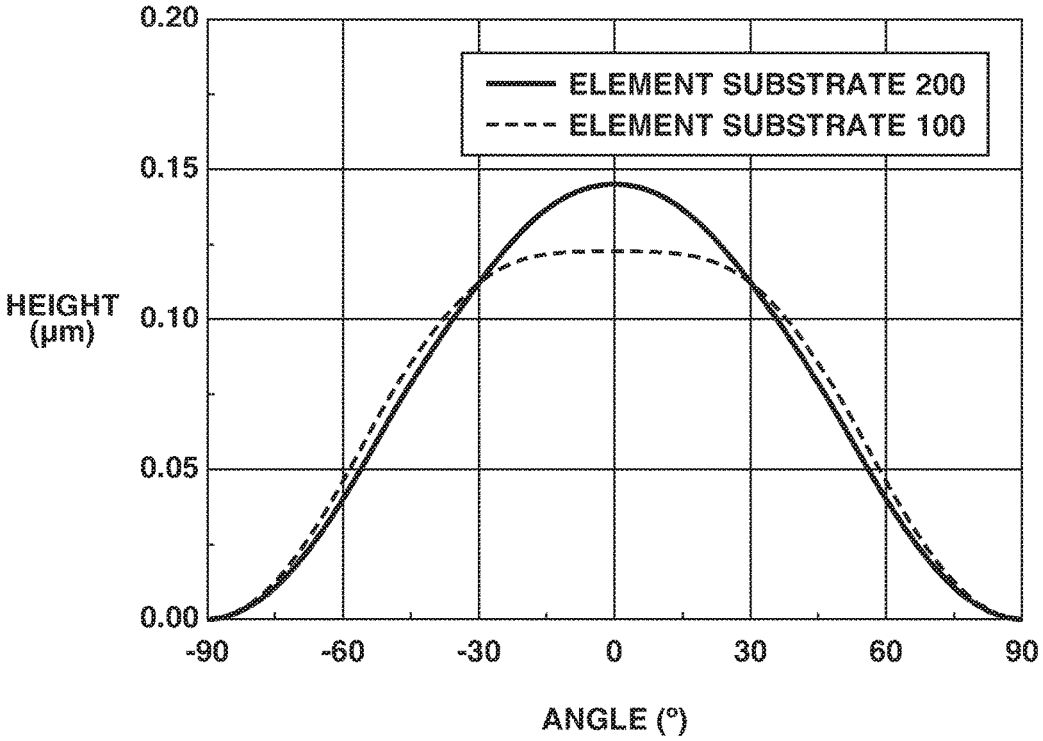
FIG. 8 illustrates another example of the height of the edge of the discharge port in the swelling state.

FIG. 8 illustrates the height of the edge of the discharge port 21 in a case where the width of the liquid flow path 20 is narrower than the above-described example. In the example illustrated in FIG. 8, the width of the liquid flow path 20 is 22 μm. In this example, the width of the liquid flow path 20 is narrow, whereby the discharge port forming member 2 is less deflected toward the substrate 1 side in the second direction Y, which corresponds to a width direction of the liquid flow path 20. Thus, the effect of canceling out the deflections is weakened, so that the effect of preventing or reducing the distortion of the discharge port 21 is also weakened. However, even the example illustrated in FIG. 8 can sufficiently prevent or reduce the deformation of the discharge port 21 compared with the element substrate 200 according to the reference example.

In the case where the width of the liquid flow path 20 is narrow, it is desirable that the thin film portion 42 of the discharge port forming member 2 is further thinned (for example, formed so as to have a film thickness of 2.2 μm at the thinnest portion). This configuration can enhance the effect of deflecting the discharge port forming member 2 toward the substrate 1 side in the second direction Y, thereby making it possible to further prevent or reduce the deformation of the discharge port 21.

FIGS. 9A to 9F illustrate a method for manufacturing the element substrate 100 according to the present exemplary embodiment. FIGS. 9A to 9F illustrate the A-A cross section taken along the line A-A illustrated in FIG. 1A and the B-B cross section taken along the line B-B illustrated in FIG. 1A in each of processes in the manufacturing method.

Figure 9A:
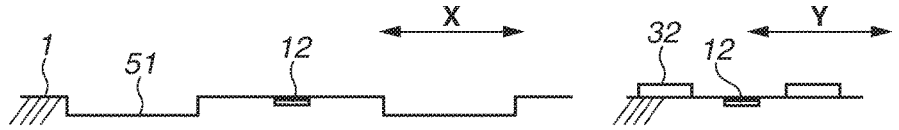
FIGS. 9A to 9F are schematic views each illustrating a method for manufacturing the element substrate according to the first exemplary embodiment of the present disclosure.

First, the substrate 1 including the energy generation element 12 is prepared. Subsequently, as illustrated in FIG. 9A, a plurality of recessed portions 51 lined up in the first direction X, and the adhesion layer 32, which is a plurality of protruding portions lined up in the second direction Y, are formed on the substrate 1. At this time, the recessed portions 51 and the adhesion layer 32 are formed so as to sandwich a predetermined region (the region where the energy generation element 12 is provided in the present example). Each of the recessed portions 51 is a dug portion formed by the substrate 1 being dug, and will be formed as the supply port 11 by the substrate 1 being dug through in a later process. Here, however, the substrate 1 is not dug through and is dug by only approximately 10 μm.

Figure 9B:
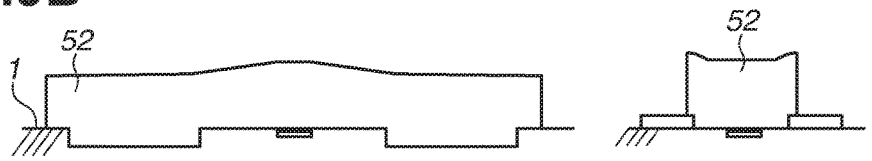

Next, as illustrated in FIG. 9B, a mold member 52 for forming the liquid flow path 20 is formed on the recessed portions 51 and the adhesion layer 32 of the substrate 1, and then is patterned into a shape of the liquid flow path 20 with use of photolithography. The mold member 52 has recesses and protrusions in conformity to recesses and protrusions formed on the substrate 1 due to the recessed portions 51 and the adhesion layer 32, on a surface thereof opposed to one side facing the recessed portions 51 and the adhesion layer 32. The mold member 52 is patterned so as to completely cover the recessed portions 51 and a part of the adhesion layer 32.

Figure 9C:
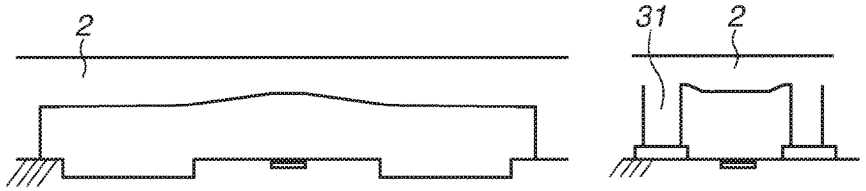
Figure 9D:
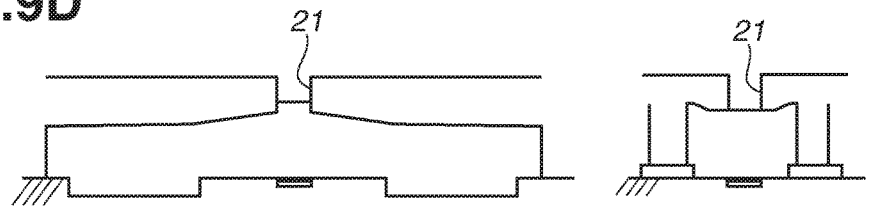

After that, the discharge port forming member 2 and the flow path wall 31 are formed by application of the resin material onto the substrate 1 and the mold member 52 as illustrated in FIG. 9C. The discharge port 21 is then formed at the position of the discharge port forming member that faces the energy generation element 12 of the substrate 1 with use of photolithography, as illustrated in FIG. 9D.

Figure 9E:
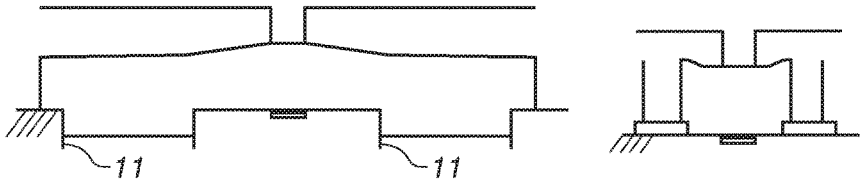
Figure 9F:
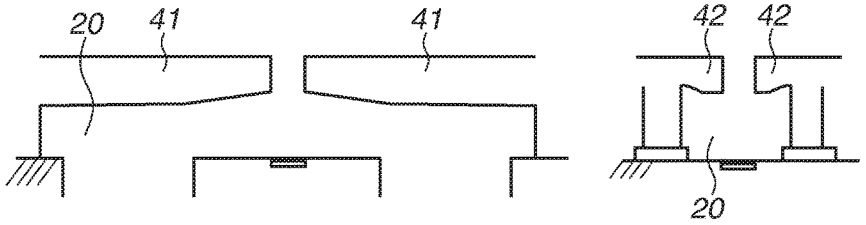

Subsequently, each of the recessed portions 51 is further dug in so as to penetrate through the substrate 1, and this through-hole is formed as the supply port 11 as illustrated in FIG. 9E. The liquid flow path 20 is then formed by removal of the mold member 52 as illustrated in FIG. 9F.

Through the above-described processes, the discharge port forming member 2 is thickened at the portion facing the recessed portion 51 formed on the substrate 1 and thinned at the portion facing the portion of the adhesion layer 32 as the protruding portion that extends beyond the flow path wail 31. Thus, the thick film portion 41 and the thin film portion 42 can be formed. In addition, since the protruding portion is formed with use of the adhesion layer 32, a load for forming the protruding portion can be reduced. Furthermore, since the supply port 11 is formed by the recessed portion 51 being further dug in, a load for forming the recessed portion 51 can be reduced.

In the above-described present exemplary embodiment, the thick film portion 41 and the thin film portion 42 are formed by the protrusion and the recess being provided on the surface of the discharge port forming member 2 on the substrate 1 side, but the protrusion and the recess may be provided on the opposite surface of the discharge port forming member 2 from the substrate 1.

In the present exemplary embodiment, the liquid flow path 20 is formed along the first direction X in which the discharge port 21 and the thick film portion 41 are lined up, and the second direction Y in which the discharge port 21 and the thin film portion 42 are lined up corresponds to the width direction of the liquid flow path 20. However, the liquid flow path 20 may be formed along the second direction Y and the first direction X may correspond to the width direction of the liquid flow path 20. In such a case, the thick film portion 41 and the thin film portion 42 can be formed by, for example, the substrate 1 being dug around the flow path wall 31 to thereby form a recessed portion before the flow path wall 31 is formed, and a protruding portion can be formed at the position of the substrate 1 that faces the flow path 24 with use of, for example, an adhesion layer before the flow path 24 is formed.

Figure 10A:
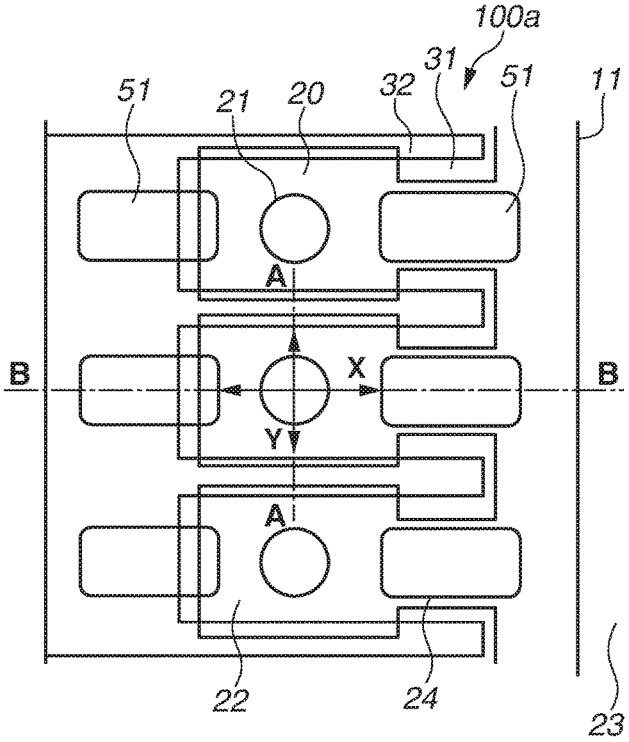
FIGS. 10A to 10C are a plan view and cross-sectional views each illustrating an element substrate according to a second exemplary embodiment of the present disclosure, respectively.
Figure 10B:
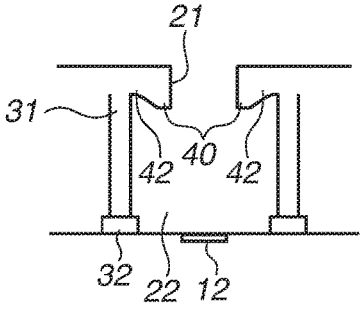
Figure 10C:
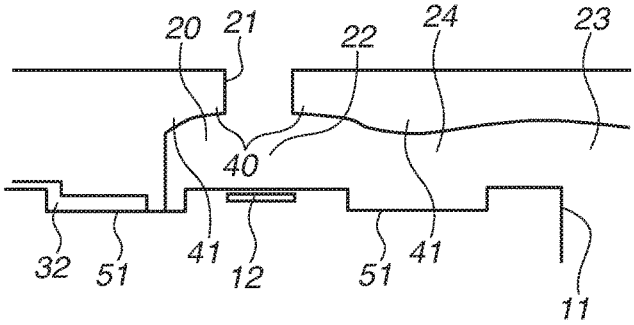

FIGS. 10A to 10C are a plan view and cross-sectional views each illustrating an element substrate according to a second exemplary embodiment of the present disclosure. More specifically, FIG. 10A is a transparent plan view of the element substrate according to the present exemplary embodiment. FIG. 10B is cross-sectional view taken along a line A-A illustrated in FIG. 10A. FIG. 10C is a cross-sectional view taken along a line B-B illustrated in FIG. 10A.

The element substrate 100*a* illustrated in FIGS. 10A to 10C is different from the element substrate 100 according to the first exemplary embodiment in terms of the supply port 11 having an elongated shape along the second direction Y and one supply port 11 in communication with a large number of pressure chambers 22 via the liquid chamber 23 and the flow path 24. Additionally, one flow path 24 is connected to one pressure chamber 22.

In the processes for manufacturing the element substrate 100 according to the first exemplary embodiment, the supply port 11 is formed by the recessed portion 51 formed on the substrate 1 being further dug in as illustrated in FIGS. 9A to 9F. By contrast, in the element substrate 100*a* according to the present exemplary embodiment, the supply port 11 is formed by a location different from the recessed portion 51 being dug in. The recessed portions 51 lined up in the first direction X remains on the element substrate 100*a*. The recessed portion 51 does not penetrate through the substrate 1, and a depth thereof is approximately 5 μm. The adhesion layer 32 provided between the substrate 1 and the flow path wall 31 extends beyond the flow path wall 31 toward the pressure chamber 22 side in the second direction Y, as in the first exemplary embodiment.

In the present exemplary embodiment, the thick film portion 41 and the thin film portion 42 are also formed by the recessed portion 51 and the portion of the adhesion layer 32 that extends beyond the flow path wall 31, as in the first exemplary embodiment. As a result, the discharge port forming member 2 is also deflected toward the side opposed to the substrate 1 in the first direction X and deflected toward the substrate 1 side in the second direction Y around the discharge port 21. Consequently, the deflections are generated in the directions causing them to cancel out each other, so that the deformation of the discharge port 21 can be prevented or reduced.

The present exemplary embodiment does not require the recessed portion 51 on the substrate 1 to be provided at the portion where the supply port 11 is formed, and thus can improve flexibility regarding the shape and the dimension of the recessed portion 51. As a result, the present exemplary embodiment makes it possible to adjust the film thickness of the discharge port forming member 2 with further high accuracy, thereby making it possible to prevent or reduce the deformation of the discharge port 21 with further high accuracy. Furthermore, the supply port 11 is formed only on one side of the pressure chamber 22, which makes it possible to reduce an area of the substrate 1.

Figure 11A:
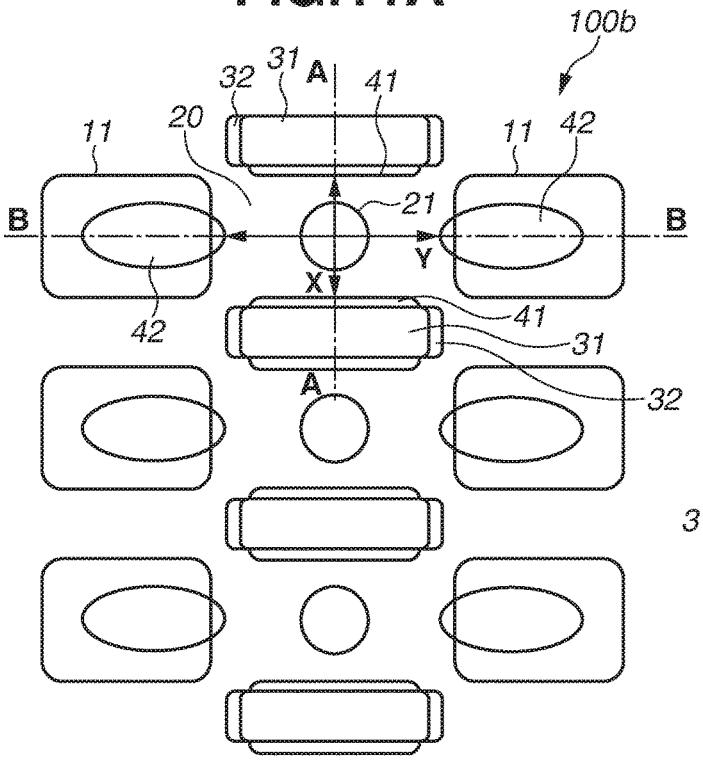
FIGS. 11A to 11C are a plan view and cross-sectional views each illustrating an element substrate according to a third exemplary embodiment of the present disclosure, respectively.
Figure 11B:
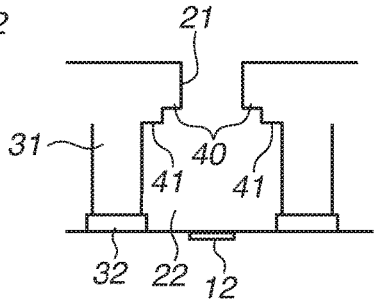
Figure 11C:
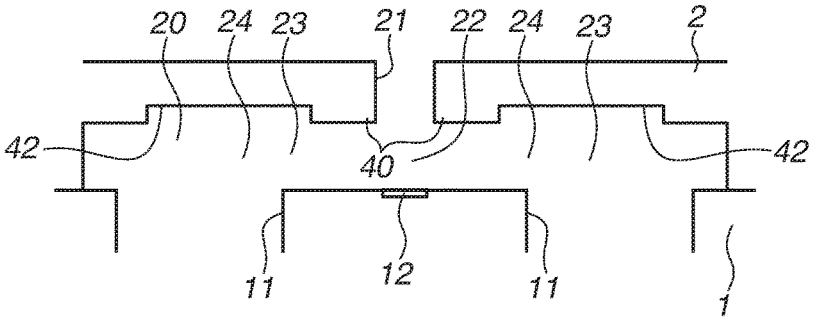

FIGS. 11A to 11C are a plan view and cross-sectional views illustrating an element substrate according to a third exemplary embodiment of the present disclosure. More specifically, FIG. 11A is a transparent plan view of the element substrate according to the present exemplary embodiment. FIG. 11B is a cross-sectional view taken along a line A-A illustrated in FIG. 11A. FIG. 11C is a cross-sectional view taken along a line B-B illustrated in FIG. 11A.

The element substrate 100*b* illustrated in FIGS. 11A to 11C is different from the element substrate 100 according to the first exemplary embodiment in that the first direction X, in which the thick film portions 41 are lined up, and the second direction Y, in which the thin film portions 42 are lined up, are interchanged with each other. More specifically, the first direction X is the direction in which the discharge port 21 and the flow path wall 31 are lined up, and the second direction Y is the direction in which the discharge port 21 and the supply port 11 are lined up. The liquid flow path 20 is provided along the first direction X. The thick film portion 41 is provided at the portion of the discharge port forming member 2 that is located adjacent to the flow path wall 31, and the thin film portion 42 is provided across from the portion facing the supply port 11 to the portion facing the flow path 24 of the discharge port forming member 2.

Further, the thicknesses of the adjacent portion 40, the thick film portion 41, and the thin film portion 42 are substantially even, and are 6 μm, 7 μm, and 5 μm, respectively. The dimensions of the other portions of the element substrate 100*b* are similar to those in the element substrate 100 according to the first exemplary embodiment.

In the present exemplary embodiment, the discharge port forming member 2 around the discharge port is also deflected toward the side opposed to the substrate 1 in the first direction X and deflected toward the substrate 1 side in the second direction Y. As a result, the deflections are generated in the directions causing them to cancel out each other, so that the deformation of the discharge port 21 can be prevented or reduced.

FIGS. 12A to 12G illustrate a method for manufacturing the element substrate 100*b* according to the present exemplary embodiment. FIGS. 12A to 12G illustrate the A-A cross section taken along the line A-A illustrated in FIG. 11A and the B-B cross section taken along the line B-B illustrated in FIG. 11A in each of processes in the manufacturing method.

Figure 12A:
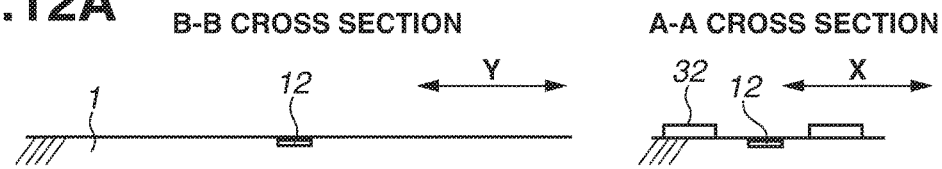
FIGS. 12A to 12G are schematic views each illustrating a method for manufacturing the element substrate according to the third exemplary embodiment of the present disclosure.
Figure 12B:
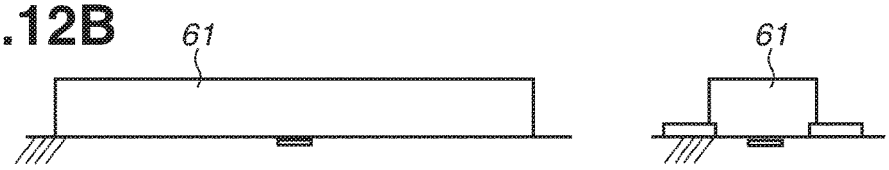
Figure 12C:
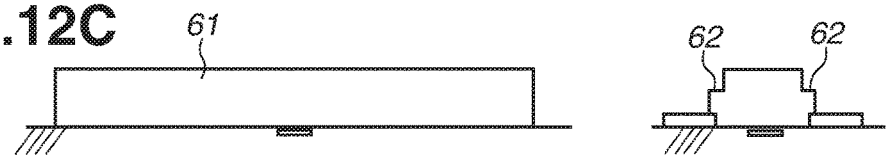

First, the substrate 1 including the energy generation element 12 is prepared. Subsequently, the adhesion layer 32 is formed on the substrate 1 illustrated in FIG. 12A. After that, a mold member 61 for forming the liquid flow path 20 is formed on the substrate 1, and is patterned into the shape of the liquid flow path 20 with use of photolithography, as illustrated in FIG. 12B. Furthermore, a plurality of recessed portions 62 is formed on the mold member 61 in the X direction so as to sandwich therebetween the region where the energy generation element 12 is provided, as illustrated in FIG. 12C.

Figure 12D:
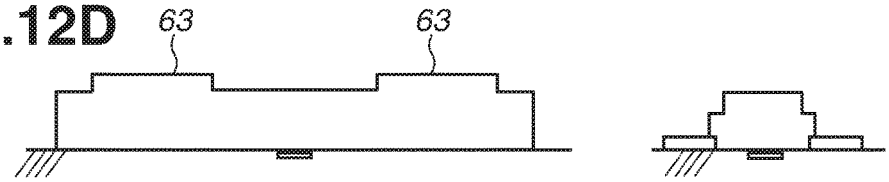
Figure 12E:
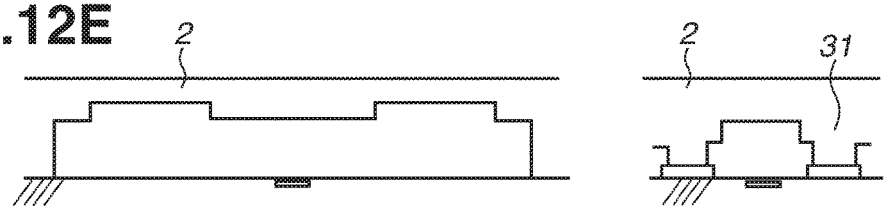

After that, as illustrated in FIG. 12D, a plurality of protruding portions 63 is formed by formation of a plurality of additional mold members on the mold member 61 in the Y direction so as to sandwich therebetween the region where the energy generation element 12 is provided. Subsequently, the discharge port forming member 2 and the flow path wall 31 are formed by application of the resin material onto the substrate 1 and the mold member 61, as illustrated in FIG. 12E.

Figure 12F:
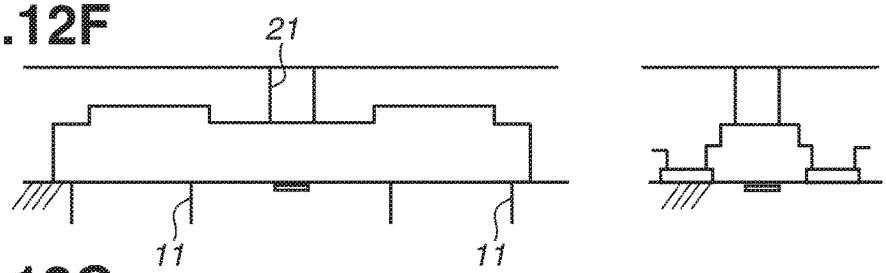
Figure 12G:
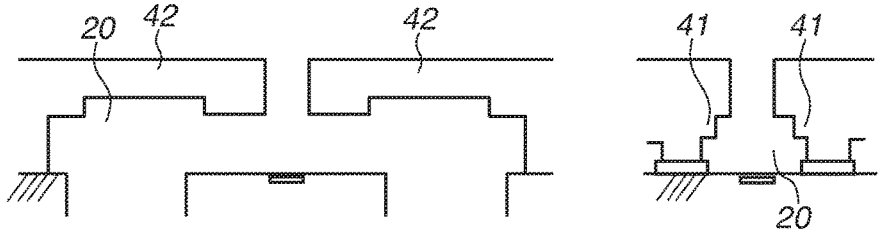

The discharge port 21 is then formed at the position of the discharge port forming member 2 that faces the energy generation element 12 of the substrate 1 with use of photolithography, as illustrated in FIG. 12F. The plurality of supply ports 11 is then formed on the substrate 1 in the Y direction so as to sandwich therebetween the region where the energy generation element 12 is provided. Subsequently, the liquid flow path 20 is formed by removing the mold member 61, as illustrated in FIG. 12G.

Through the above-described processes, the portion of the discharge port forming member 2 that corresponds to the recessed portion 62 of the mold member 61 is formed as the thick film portion 41, and the portion of the discharge port forming member 2 that corresponds to the protruding portion 63 of the mold member 61 is formed as the thin film portion 42. A part of the adhesion layer 32 extends beyond the flow path wall 31 toward the liquid flow path 20 side, but the portion corresponding to the recessed portion 62 can be formed as the thick film portion 41 by the recessed portion 62 being dug more deeply than a height of the protruding portion due to this portion that extends beyond the flow path wall 31.

The illustrated configuration in each of the above-described exemplary embodiments is merely one example, and the present disclosure is not limited to the configuration. For example, the present disclosure can also be applied to a liquid discharge head including a circulation configuration that supplies the liquid from a liquid storage portion in the main body of the liquid discharge apparatus to the liquid discharge head and collects the liquid unused for the discharge from the liquid discharge head to the liquid discharge apparatus side. In this case, the liquid in the pressure chamber 22 is circulated between the pressure chamber 22 and an outside of this pressure chamber 22. In this manner, the liquid discharge head including the circulation configuration causes flesh ink to be supplied to the liquid discharge head as needed, thereby further increasing an influence on the swelling of the discharge port forming member. Accordingly, the present disclosure can be further effectively applied.

According to the present disclosure, on the discharge port forming member, the plurality of thick film portions thicker than the adjacent portion adjacent to the discharge port is lined up in the first direction so as to sandwich the discharge port therebetween, and the plurality of thin film portions thinner than the adjacent portion is lined up in the second direction intersecting with the first direction so as to sandwich the discharge port therebetween. This configuration allows the discharge port forming member around the discharge port to be deflected toward the side opposed to the substrate in the first direction and be deflected toward the substrate side in the second direction when the substrate is swelling. In other words, the present disclosure allows the respective deflections in the first direction and the second direction to be generated in the directions causing them to cancel out each other. Therefore, the present disclosure can prevent or reduce the deformation of the discharge port due to the swelling even without providing the hollow portion in the wall member or disposing the plurality of discharge port forming members while spacing them apart from each other, thereby making it possible to easily prevent or reduce the deformation of the discharge port.

While the present disclosure has been described with reference to exemplary embodiments, it is be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-168005, filed Aug. 30, 2016, which is hereby incorporated by reference herein in its entirety.

What is claimed is:

1. A liquid discharge head comprising:

substrate including an energy generation element configured to generate energy to be used to discharge liquid; and a discharge port forming member including a discharge port configured to discharge the liquid, wherein the discharge port forming member includes, on a surface opposed to a surface where the discharge port is provided, a liquid flow path configured to supply the liquid to the energy generation element, and includes thick film portions and thin film portions in a region where the liquid flow path is formed, the thick film portions being lined up in a first direction so as to sandwich the discharge port therebetween and thicker than an adjacent portion adjacent to the discharge port, the thin film portions being lined up in a second direction intersecting with the first direction so as to sandwich the discharge port therebetween and thinner than the adjacent portion.

2. The liquid discharge head according to claim 1, further comprising:

a pressure chamber including the energy generation element therein, wherein the liquid in the pressure chamber is circulated between the pressure chamber and an outside of the pressure chamber.

* * * * *